US008316500B2

(12) United States Patent
Freeman et al.

(10) Patent No.: US 8,316,500 B2
(45) Date of Patent: Nov. 27, 2012

(54) BIDIRECTIONAL BRISTLE PIG WITH SLIDING COLLAR

(75) Inventors: Eric N. Freeman, Kiefer, OK (US); Joseph Alan Morton, Tulsa, OK (US)

(73) Assignee: TDW Delaware, Inc., Wilmington, DE (US)

( * ) Notice: Subject to any disclaimer, the term of this patent is extended or adjusted under 35 U.S.C. 154(b) by 484 days.

(21) Appl. No.: 12/637,231

(22) Filed: Dec. 14, 2009

(65) Prior Publication Data

US 2011/0138555 A1 Jun. 16, 2011

(51) Int. Cl.
*B08B 9/055* (2006.01)

(52) U.S. Cl. ..... 15/104.061; 15/104.17; 15/104.18

(58) Field of Classification Search ..... 15/104.061, 15/104.17, 104.18
See application file for complete search history.

(56) References Cited

U.S. PATENT DOCUMENTS

| | | | | | |
|---|---|---|---|---|---|
| 289,132 | A | * | 11/1883 | Petmecky | 15/104.18 |
| 753,189 | A | * | 2/1904 | Buckelew | 15/104.18 |
| 4,016,620 | A | | 4/1977 | Powers | |
| 4,247,964 | A | * | 2/1981 | Lichliter et al. | 15/104.067 |
| 4,413,370 | A | | 11/1983 | Payne et al. | |
| 4,907,314 | A | | 3/1990 | Kershaw | |
| 5,003,657 | A | * | 4/1991 | Boiteau et al. | 15/104.33 |
| 5,230,842 | A | | 7/1993 | Munde | |
| 5,625,917 | A | | 5/1997 | Hawkins | |
| 5,795,402 | A | | 8/1998 | Hargett, Sr. et al. | |
| 5,809,603 | A | * | 9/1998 | White | 15/104.04 |
| 6,014,789 | A | | 1/2000 | Knapp | |
| 6,070,285 | A | | 6/2000 | Geppert | |
| 6,173,469 | B1 | | 1/2001 | Laymon | |
| 6,651,744 | B1 | | 11/2003 | Crawford | |
| 7,386,908 | B2 | | 6/2008 | Lino et al. | |
| 7,458,289 | B2 | | 12/2008 | Houldey et al. | |
| 2003/0041400 | A1 | | 3/2003 | Knapp | |
| 2007/0151055 | A1 | | 7/2007 | Chee et al. | |
| 2007/0161339 | A1 | | 7/2007 | Wentworth et al. | |
| 2007/0261186 | A1 | | 11/2007 | Batzel | |
| 2008/0105199 | A1 | | 5/2008 | Martin et al. | |
| 2008/0141474 | A1 | | 6/2008 | Kapustin et al. | |
| 2008/0276731 | A1 | | 11/2008 | Fagbayi et al. | |
| 2009/0078283 | A1 | | 3/2009 | Phipps | |

* cited by examiner

*Primary Examiner* — Randall Chin
(74) *Attorney, Agent, or Firm* — Gable Gotwals

(57) ABSTRACT

A bidirectional bristle pig provides a means for collapsing or restraining the bristles so that the pig may be used in a reciprocating manner or, when the pig becomes stuck, the pig may be easily retrieved in a direction opposite that of the initial direction of travel. The bristle pig has at least one set of outwardly projecting cleaning wires or bristles located toward one end of the pig body and a sliding collar. The sliding collar moves between a first position and a second position to restrain the bristles at the desired leading end of the pig and forces the bristles downward and away from the inner wall surface of the pipeline. In the restrained state, the bristles no longer interfere with the movement of the pig in the desired direction. The sliding collar may move in response to pipeline pressure or may include a tether line.

10 Claims, 8 Drawing Sheets

BIDIRECTIONAL BRISTLE PIG WITH SLIDING COLLAR

BACKGROUND OF THE INVENTION

This invention relates generally to pipeline pigs that service a pipeline and move forward through the interior of the pipeline either by means of a tether or by the flow of pressurized gas or liquid. More specifically, this invention relates to pipeline pigs which are designed to scratch the interior surface of a pipeline to dislodge pits and other debris.

A wide variety of pipeline pigs for inspecting, servicing, and maintaining pipelines have been developed for use in the pipeline industry. One type of pipeline pig, commonly known as a "bristle pig," is equipped with a set of wires or bristles on one end of the pig. Bristle pigs have been used for some time in the pipeline industry to scratch the interior surface of a pipeline to dislodge pits and other debris. Bristle pigs are typically moved through the pipeline either by pulling the pig through the pipeline or, more commonly, by forcing the pig to move forward in response to pipeline pressure or fluid flow. However, because of the orientation of the bristles—which extend radially upward and away from the leading end (or direction of travel) of the pig—bristle pigs are unidirectional. If the pig becomes stuck in the pipeline the bristles prevent the pig from being dislodged by pulling or propelling it in the opposite direction or reversing the direction of fluid flow. In many cases, the only means of removal is digging up a portion of the pipeline containing the stuck bristle pig and extracting the pig. Therefore, a need exists for a bidirectional bristle pig. Also, in some cases, a need exists for cleaning a portion of piping in a reciprocating fashion, that is, pulling or propelling the bristle pig in one direction and then the other.

SUMMARY OF THE INVENTION

A bidirectional bristle pig made according to this invention provides a means for collapsing or restraining the bristles so that the pig may be run in a bi-directional mode or, when the pig becomes stuck within the interior of a pipeline, the pig may be easily retrieved in a direction opposite that of the initial direction of travel. The bristle pig has at least one set of outwardly projecting cleaning wires or bristles located toward one end of the pig body and a sliding collar (sleeve) circumferentially disposed about the body of the pig. The sliding collar moves between a first position and a second position. When the sliding collar is in the first position, the sliding collar slides over a portion of the bristles and forces or collapses the bristles downward and away from the inner surface of the pipeline. When the sliding collar is in the second position, the sliding collar releases the collapsed portion of the bristles so that the bristles may come into contact with an interior surface of the pipeline.

In a preferred embodiment of the bristle pig, one or more sets of bristles are located toward each opposing end of the pig. The sliding collar includes a set of radial sealing discs that make the collar responsive to the direction of pipeline product flow. When the sliding collar moves in the direction of product flow (toward the leading end of the pig), the collar collapses a portion of the set of bristles located at the leading end while at the same time moving away from and releasing a portion of the set of bristles located at the trailing end. The sliding collar is stopped in its direction of travel by the radial sealing disc of the collar contacting the flange that retains the set of bristles. When the sliding collar is in a neutral position, both sets of bristles are released. By restraining the bristles at the leading end, the pig may be moved forward in the desired direction without damage to the pig or the pipeline wall.

The sealing discs may be replaced by a set of guide discs which guide the sliding collar as it moves from one end of the pig body to the other. In this embodiment, the sliding collar moves in response to a tether line affixed to each end of the sliding collar, collapsing the bristles as the tether line moves the collar in the direction in which the tether line is being pulled. The sliding collar, which may be sized to completely encase or capture the bristle set, is stopped in its direction of travel by the end of the sliding collar contacting the radial sealing disc of the pig body.

DETAILED DESCRIPTION OF THE PREFERRED EMBODIMENTS

Figure 1:
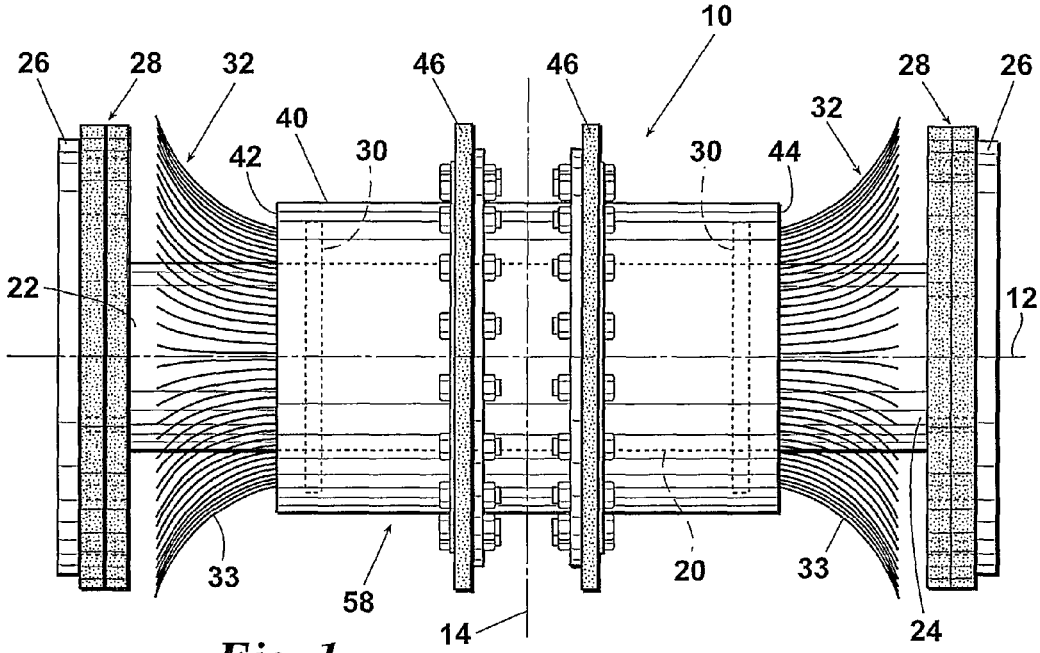
FIG. 1 is an elevational view of a preferred embodiment of a bidirectional bristle pig made according to this invention. The pig includes a sliding collar (sleeve)—illustrated here in its neutral or free position—that moves in response to pipeline pressure to force downward or compress a set of cleaning wires or bristles located at a forward (leading) end of the pig.

Preferred embodiments of a bidirectional bristle pig will now be described by making reference to the drawings and the following elements illustrated in the drawings:

10 Bidirectional bristle pig
12 Longitudinal centerline of 10
14 Lateral centerline of 10
16 Leading end of 10
18 Trailing end of 10
20 Cylindrical-shaped body
22 First end of 20
24 Second end of 20
26 Guide disc
28 Sealing disc
29 Bypass holes in 26 & 28
30 Flange for securing 32
32 Set of cleaning wires or bristles
33 Cleaning wire or bristle
34 Free or unrestrained diameter of 32
36 Collapsed or restrained diameter of 32
38 Collapsed or restrained portion of 32
40 Sliding collar or sleeve
42 First end of 40
44 Second end of 40
46 Sealing disc
47 Guide disc
50 Tether line
52 Guide rod
54 First position of 40
56 Second position of 40
58 Neutral position of 40

Figure 2:
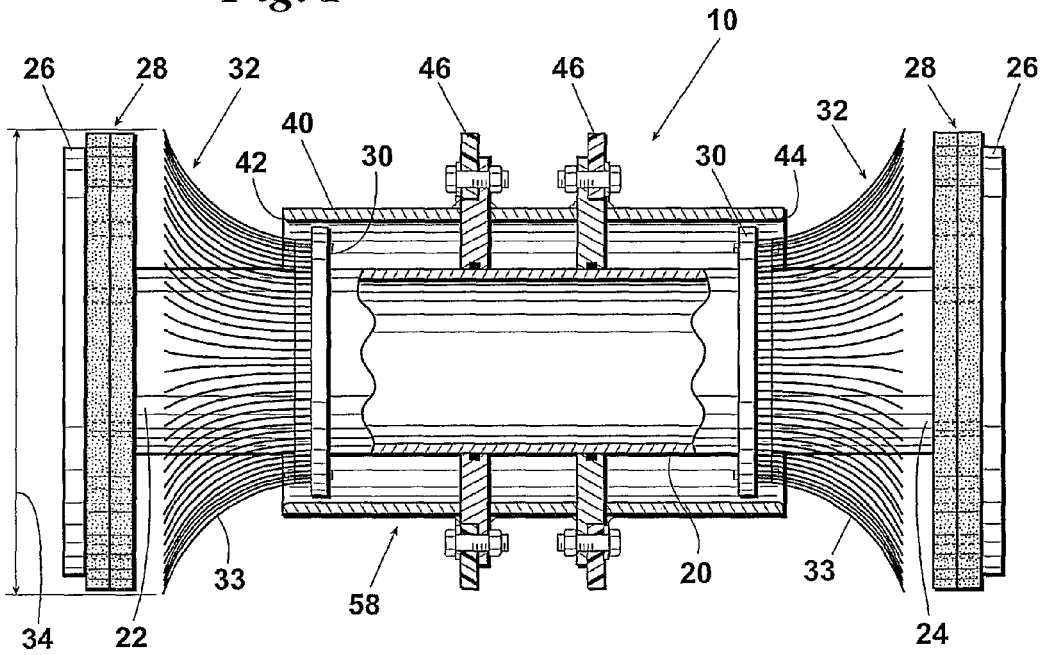
FIG. 2 is a partial cross-sectional view of the bristle pig illustrated in FIG. 1. The pig includes a guide disc and set of radial sealing discs at each opposing end and a pair of flanges located toward each end that retain a set of outwardly projecting cleaning wires or bristles. The sliding collar moves fore and aft relative to the pig body and includes a set of radial sealing discs circumferentially disposed about an external surface of the pig body.
Figure 3:
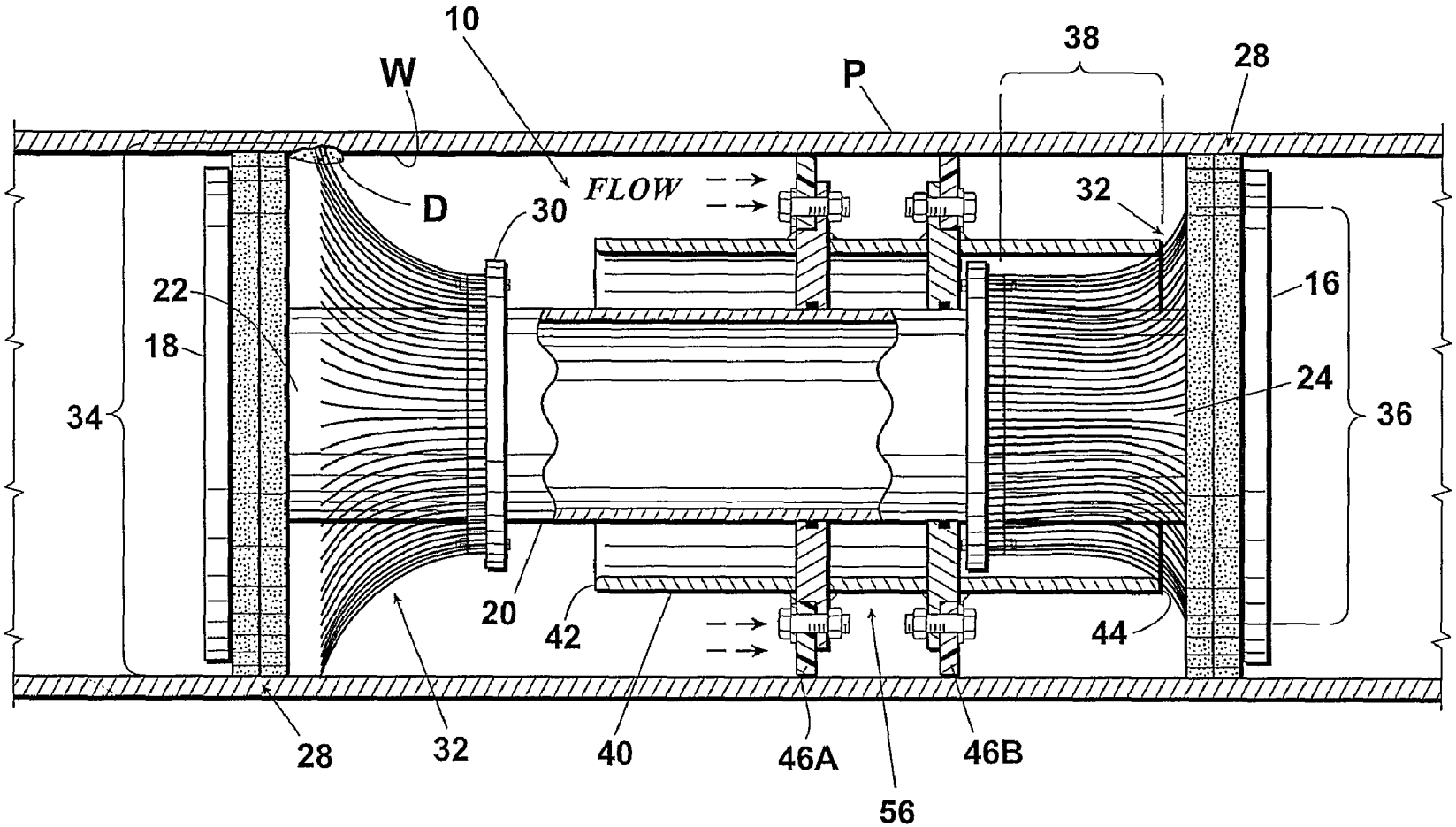
FIG. 3 is a view of the bristle pig of FIG. 1, illustrating the position of the sliding collar being controlled by the direction of fluid flow. The sliding collar moves in the direction of fluid flow to slide over the bristles located at the forward or leading end of the pig (relative to fluid flow) and force these bristles downward. Because the collar has moved toward the leading end on the pig, the bristles located toward the rearward or trailing end are released and come into contact with an inner surface of the pipeline.
Figure 4:
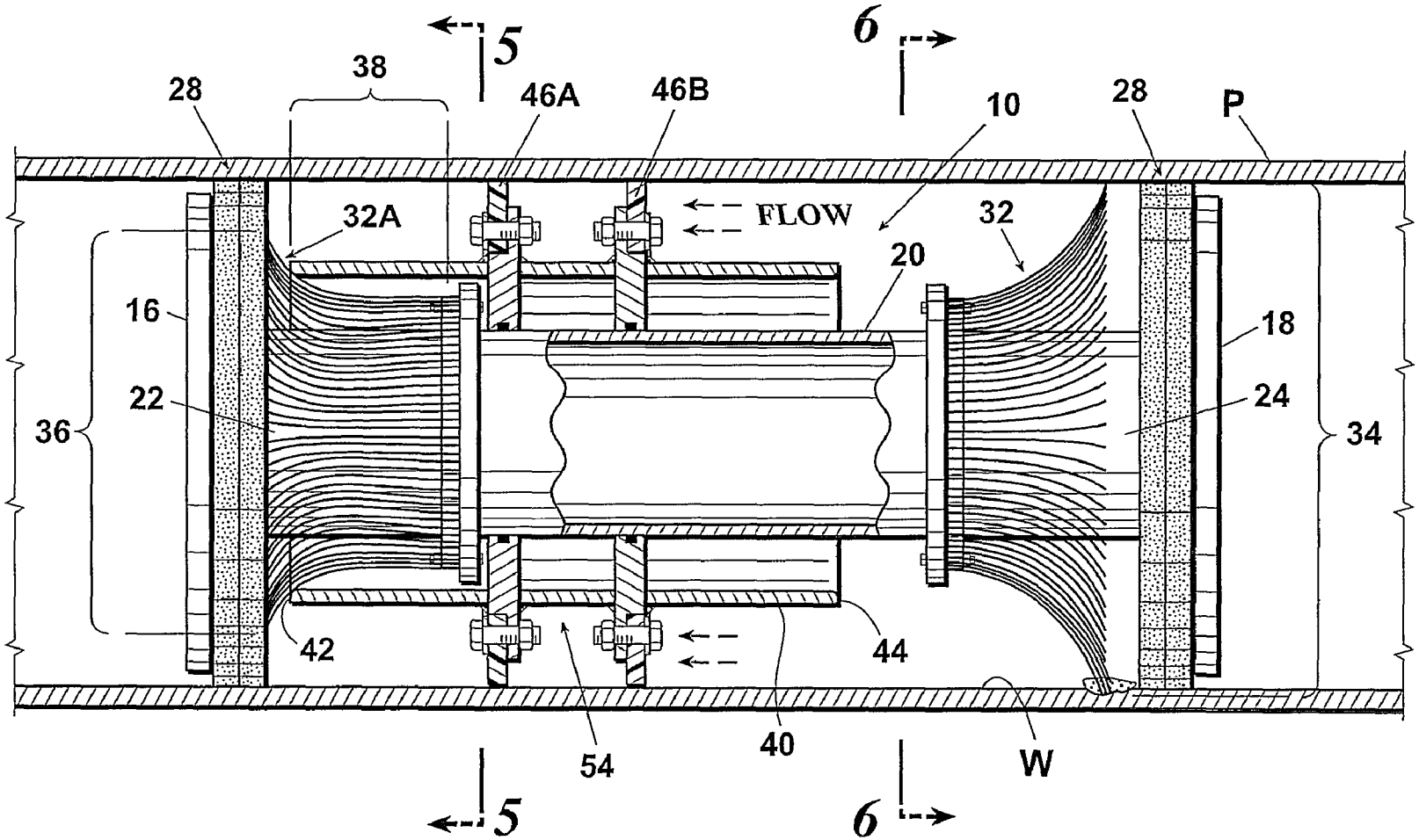
FIG. 4 is a view of the bristle pig of FIG. 3 illustrating the fluid flow being reversed from that of FIG. 3. The sliding collar again moves in the direction of fluid flow to compress the bristles located toward the leading end and release the bristles located toward the trailing end. This allows the pig to move in the reverse direction of that of FIG. 3. The direction of travel may be reversed any time the fluid flow is reversed to slide the collar in one direction or the other. The radial sealing disc of the collar located toward the leading end of the pig urges against the flange of the pig body that retains the bristles to stop the forward movement of the sliding collar.
Figure 5:
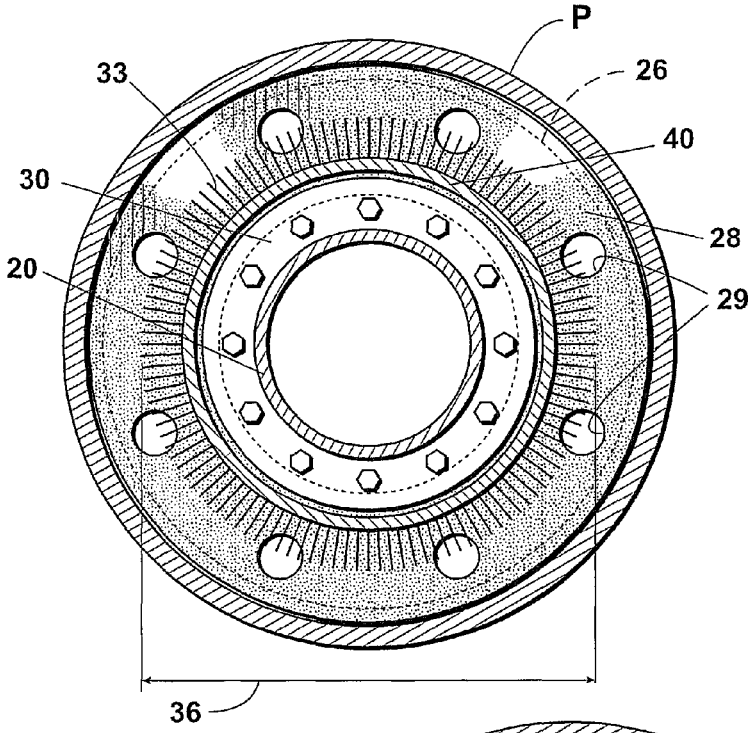
FIG. 5 is a view of the bristle pig taken along section line 5-5 of FIG. 4, illustrating the compressed bristles located at the leading end of the pig. The radial sealing discs of the pig body have openings to allow fluid flow (pressure) to reach the radial sealing discs of the sliding collar, thereby allowing the collar to move in the direction of flow, compressing the bristles and allowing the pig to move forward under differential pressure.
Figure 6:
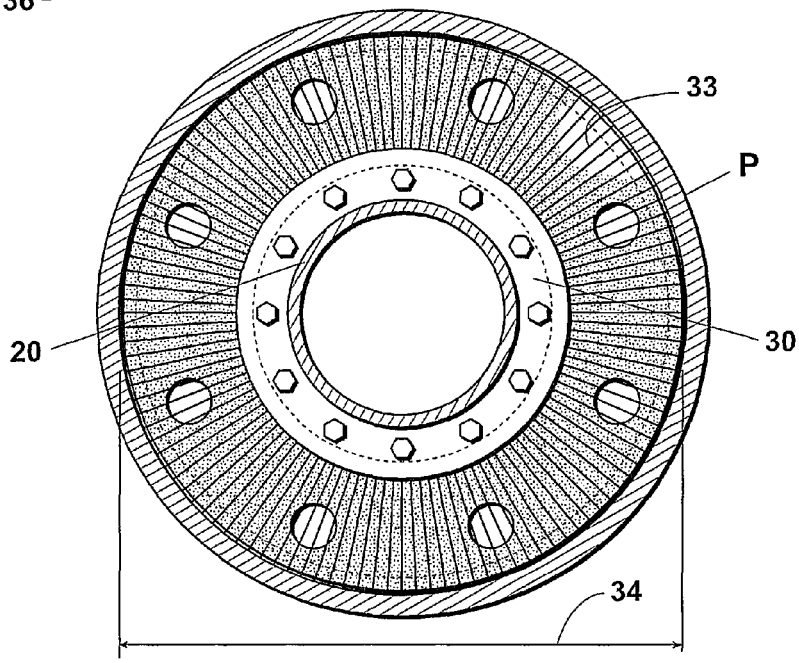
FIG. 6 is a view of the bristle pig taken along section line 6-6 of FIG. 4, illustrating the expanded or released bristles located at the trailing end of the pig, unrestrained by the sliding collar.
Figure 7:
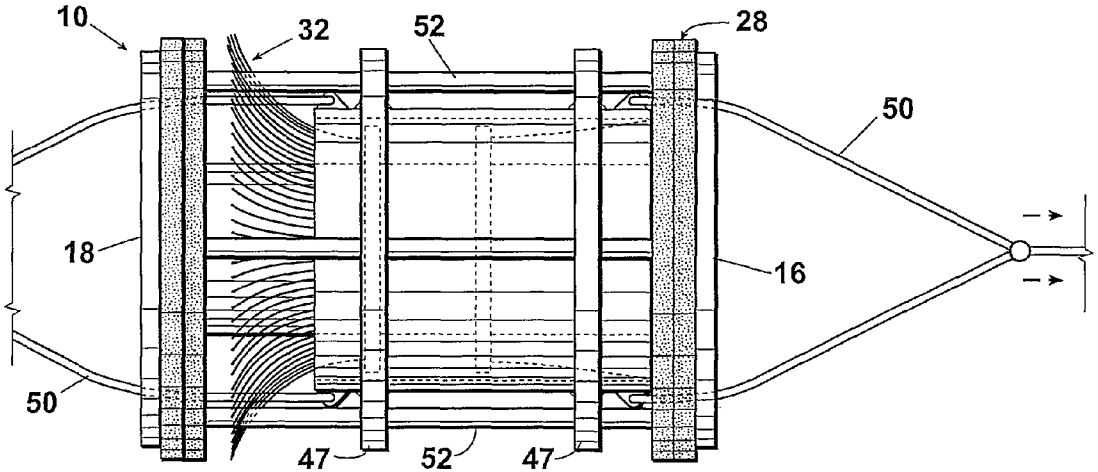
FIG. 7 is an alternate embodiment of a bidirectional bristle pig made according to this invention. A tether line is affixed to each end of the sliding collar to pull the collar toward a selected end of the pig body. A set of guide rods are received by the guide discs of the sliding collar to guide the collar as it moves fore and aft.
Figure 11:
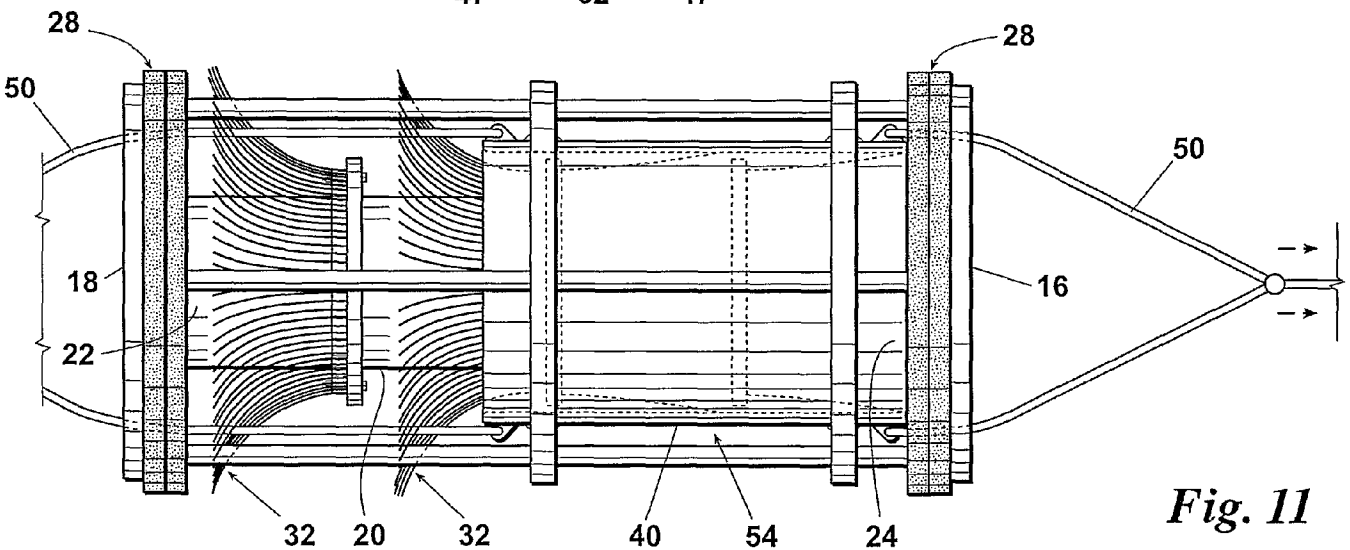
FIG. 11 is another preferred embodiment of a bidirectional bristle pig made according to this invention. A second set of bristles is located toward each end of the pig body.

Referring now to FIGS. 1 & 2, a bi-directional bristle pig 10 made according to this invention includes a sliding collar (sleeve) 40 that moves fore and aft relative to a cylindrical-shaped pig body 20 to compress or release a set of outwardly extending cleaning wires or bristles 32 located at each end 22, 24 of a body 20. Preferably, bristle pig 10 is symmetrical relative to its longitudinal centerline 12 and lateral centerline 14. Body 20 includes an opposing pair of guide discs 26 and an opposing set of radial sealing discs 28 to move bristle pig 10 forward under differential pressure through an interior space of a pipeline. Sliding collar 40 includes a pair of radial sealing discs 46 that are circumferentially disposed about an external surface of body 20 and move sliding collar 40 fore and aft. Discs 46 are preferably flexible seal discs that have no or very small bypass holes. Radial sealing discs 28 are preferably perforated discs having bypass holes 29 that allow a predetermined amount of product flow to flow past the discs 28 (see e.g. FIG. 5) to allow flow or pressure to drive the discs 46 and thus the pig 10. Depending on the direction of product flow in the pipeline—and therefore the direction of travel of pig 10—end 22 may be a leading end and end 24 may be a trailing end (or vice versa).

Regardless of the direction of travel of bristle pig 10, each set of bristles 32 is secured by a flange 30 located toward each end 22, 24 of pig body 20 and includes a plurality of individual bristles 33. In a free or unrestrained state, the bristles 33 "fan out" to a diameter 34 and extend toward the end 22 or 24 of the body 20 nearest the bristles 33 and away from a longitudinal centerline 12 of bristle pig 10. Both sets of bristles 32 are in the unrestrained state when sliding collar 40 is in a neutral position 58, that is, when sliding collar 40 is substantially centered relative to lateral centerline 14. In the neutral position 58, the end 42, 44 of sliding collar 40 does not come into contact with the bristle set 32 lying nearest to and opposite the end 42, 44, respectively.

Turning to FIGS. 3-6, sliding collar 40 moves substantially instantaneously in response to a change in product flow in a pipeline P between a first position 54 (FIG. 4)—in which the set of bristles 32 located toward end 22 are collapsed—to a second position 56 (FIG. 3) in which the set of bristles 32 located toward end 24 are collapsed. Generally speaking, when bristle pig 10 is launched into pipeline P, sliding collar 40 moves in response to pipeline pressure or product flow to force downward or collapse a portion 38 of the set of bristles 32 located toward the leading end 16 of the pig 10. The movement of collar 40 is arrested by the radial sealing disc 46 in the direction of travel contacting flange 30.

In the collapsed or restrained state, the restrained set of bristles 32 has a diameter 36 that is smaller than its diameter 34 in the free or unrestrained state. Restrained diameter 36 is a diameter effective for allowing bristle pig 10 to move forward under differential pressure without interference from the restrained set of bristles 32 located toward the leading end 16. Unrestrained diameter 34 is a diameter effective for the unrestrained set of bristles 32 located toward the trailing end 18 to urge against the interior wall surface W of pipeline P and scratch the wall surface W to dislodge pits and other rough spots or debris D.

Figure 8:
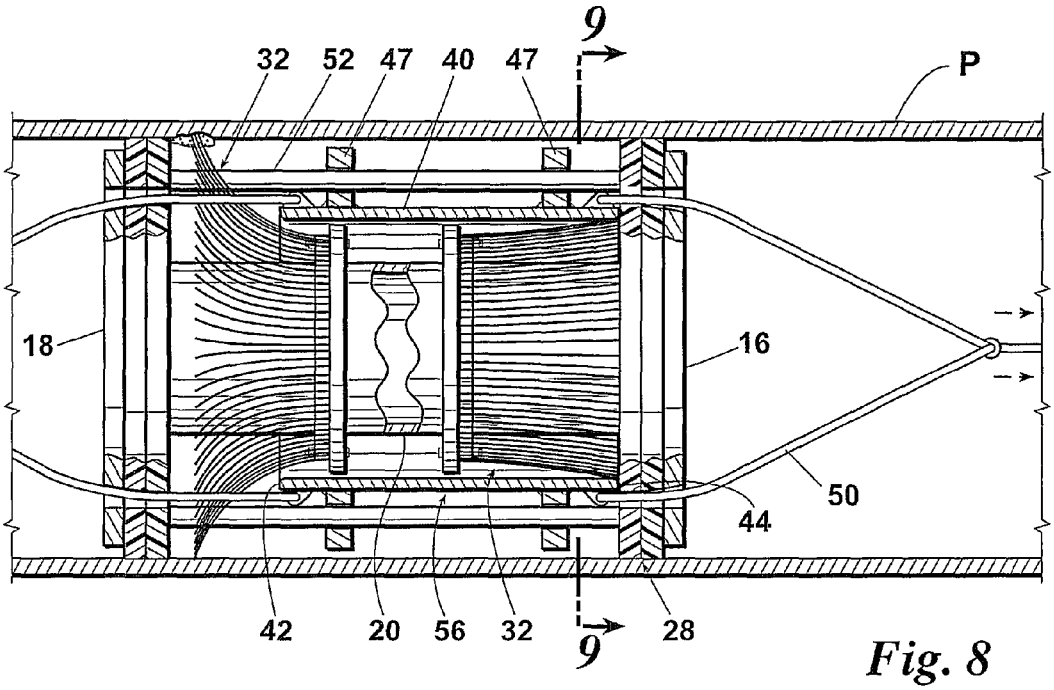
FIG. 8 is a partial cross-sectional view of the bristle pig of FIG. 7. The bristles and the flanges that retain the bristles are received by the sliding collar. The forward travel of the collar is arrested by the radial sealing disc located at the leading end of the pig.
Figure 10:
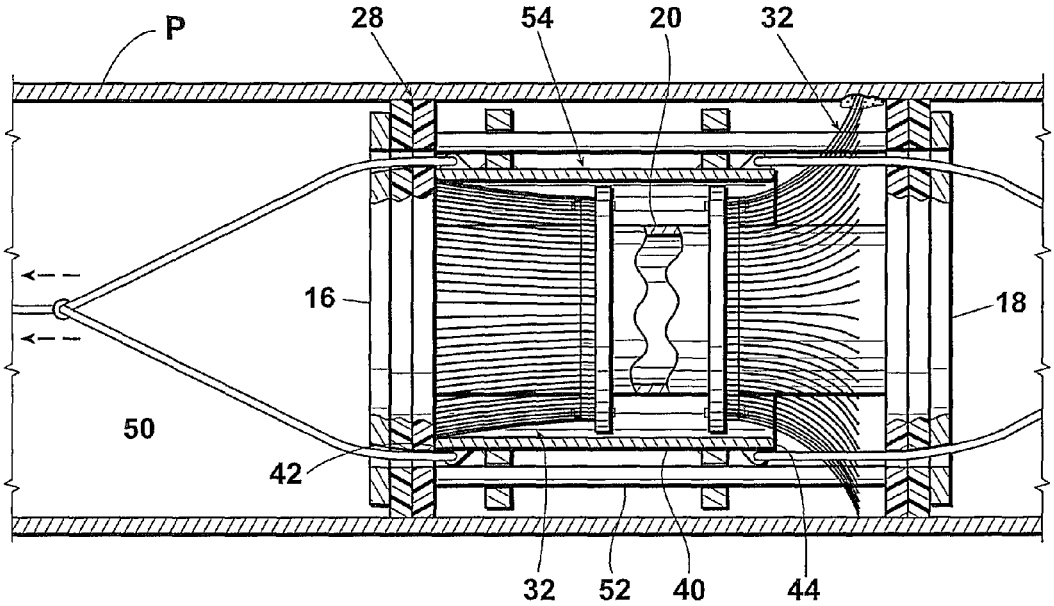
FIG. 10 is a view of the bristle pig of FIG. 7 illustrating the fluid flow and direction of pull being reversed from that of FIG. 7.
Figure 15:
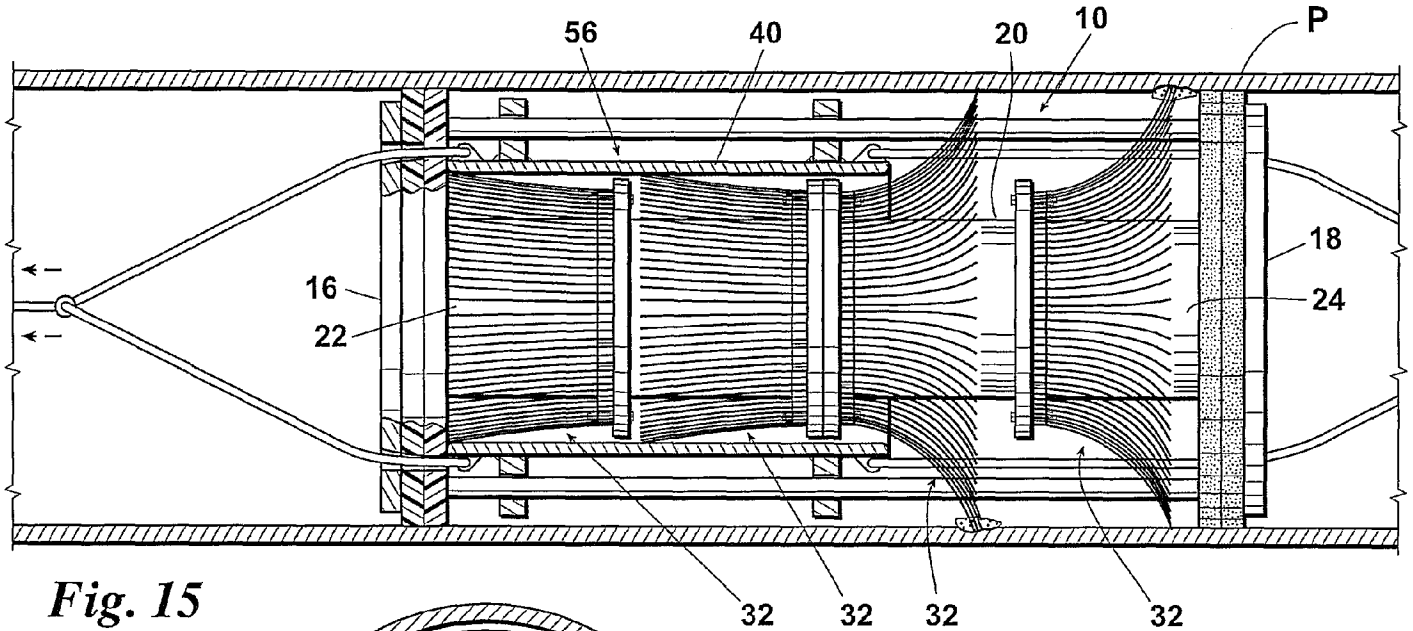
FIG. 15 is a view of the bristle pig of FIG. 12, illustrating the fluid flow being reversed from that of FIG. 12. Because the sliding collar has collapsed the two sets of bristles located toward the leading end of the pig and released the bristles located toward the trailing end, the pig may now travel right to left.
Figure 9:
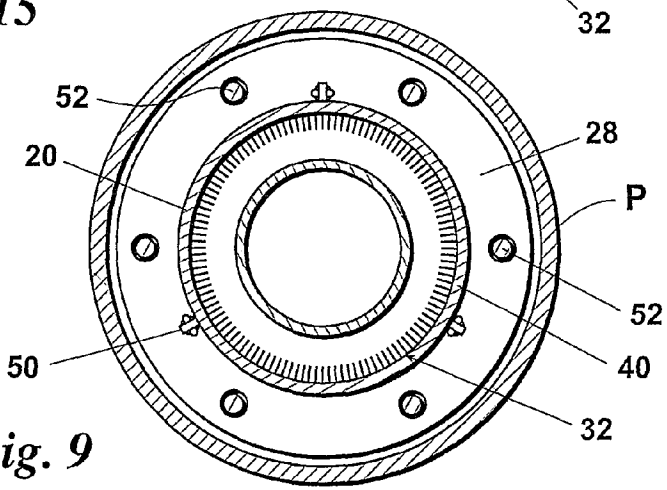
FIG. 9 is a view of the bristle pig taken along section line 9-9 of FIG. 8. The sliding collar completely encompasses and captures the bristles located at the leading end of the pig.
Figure 12:
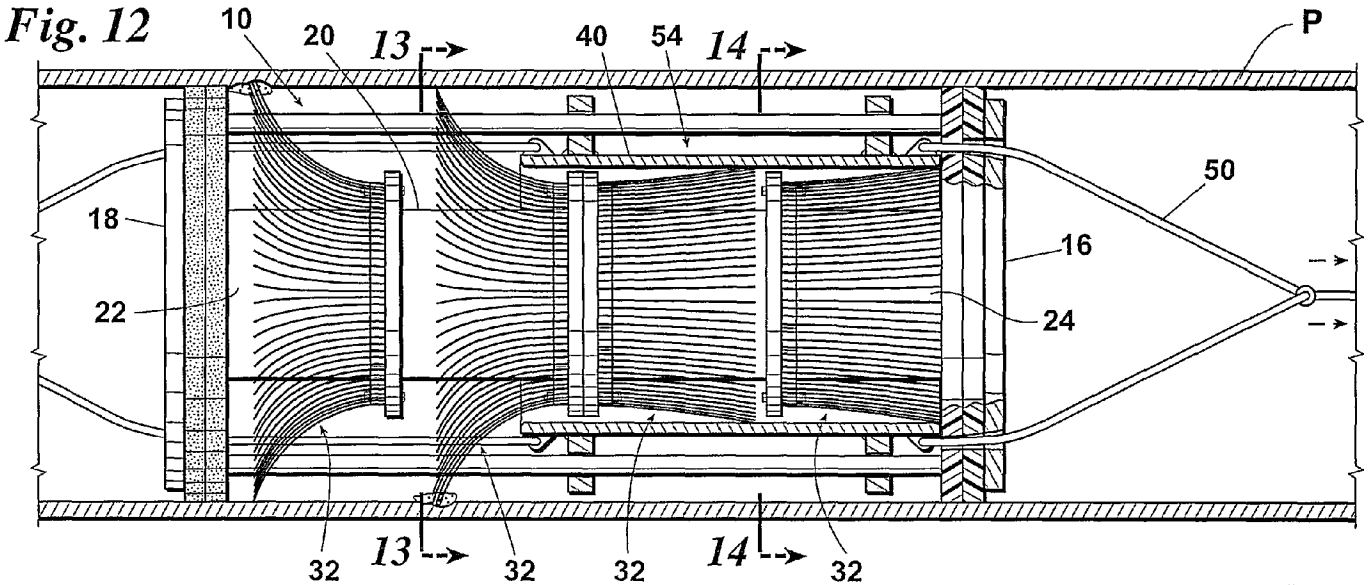
FIG. 12 is a partial cross-sectional view of the bristle pig of FIG. 11. As in the other embodiments of the bristle pig, the sliding collar captures or collapses the bristles located toward the leading end of the pig and releases those located toward the trailing end.
Figure 14:
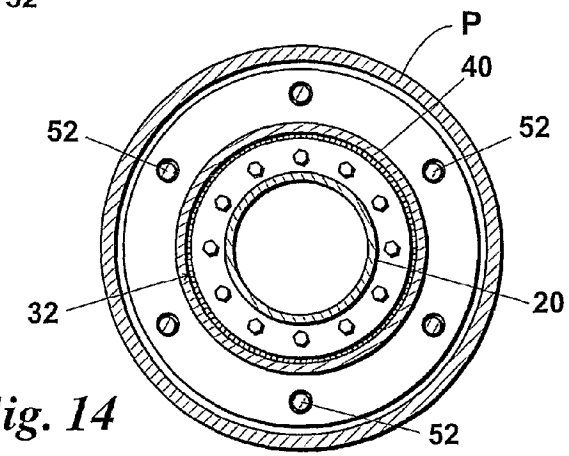
FIG. 14 is a view of the bristle pig taken along section line 14-14 of FIG. 12. The sliding collar has captured and collapsed the two sets of bristles located toward the leading end of the pig, allowing the pig to travel left to right.
Figure 13:
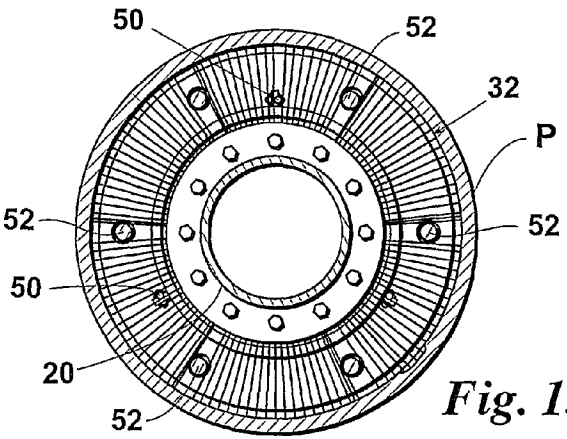
FIG. 13 is a view of the bristle pig taken along section line 13-13 of FIG. 12. The sliding collar has moved clear of the two sets of bristles located toward the trailing end of the pig, allowing the bristles to extend outward and contact the inner surface of the pipeline wall.

Referring to FIGS. 7-10, another preferred embodiment of bristle pig 10 includes a tether line 50 affixed to each end 42, 44 of sliding collar 40. Sliding collar 40 responds to the direction of pull on tether line 50 to move sliding collar 40 between its first position 54 (FIG. 10) and second position 56 (FIG. 8). The radial sealing discs 46 of FIGS. 1-6 may be replaced by guide discs 47 that may, as an alternative to being guided by the pig body 20, receive a plurality of static rods 52 which extend between the ends 22, 24 of body 20. Sliding collar 40 moves fore and aft guided by these rods 52 or by the body 20. When moving into the first position 54 or second position 56 the forward movement of sliding collar 40 is arrested by its leading end 42 or 44 contacting the radial sealing disc 28 located at the leading end 16 of pig 10. Sliding collar 40 is preferably sized to completely encase or capture the set of bristles 32 located toward the trailing end 18.

FIGS. 11-15 illustrate yet another preferred embodiment of bristle pig 10. A second set of bristles 32 is located toward each end 22, 24 of body 20. As in the other embodiments of the bristle pig 10, sliding collar 40 collapses or restrains the bristles 33 located toward the leading end 16 of pig 10 and releases the bristles 33 located toward the trailing end 18. The radial sealing disc 46 arrangement of FIGS. 1-6 may also be used in combination with multiple sets of bristles 32 located toward each end 22, 24 of the body 20.

While a bidirectional bristle pig with sliding collar has been described with a certain degree of particularity, many changes may be made in the details of construction and the arrangement of components and steps without departing from the spirit and scope of this disclosure. A bidirectional bristle pig according to this disclosure, therefore, is limited only by the scope of the attached claims, including the full range of equivalency to which each element thereof is entitled.

What is claimed is:

1. A pipeline pig comprising:

a cylindrical-shaped body having a first end and a second end and a circumferential sealing disc located at each said end;

at least one set of outwardly projecting cleaning wires located toward one of said first and second ends of said cylindrical shaped body; and a sliding collar circumferentially disposed about an external surface of said cylindrical-shaped body, said sliding collar being capable of moving between a first position and a second position relative to said cylindrical-shaped body;

wherein said sliding collar when in said first position collapses a portion of said set of outwardly projecting cleaning wires and when in said second position releases the collapsed portion of said set of outwardly projecting cleaning wires.

2. A pipeline pig comprising:

a cylindrical-shaped body having a first end and a second end;

a first and a second set of outwardly projecting cleaning wires, said first set of outwardly projecting cleaning wires being located toward said first end of said cylindrical shaped body and said second set of outwardly projecting cleaning wires being located toward said second end of said cylindrical shaped body; and a sliding collar circumferentially disposed about an external surface of said cylindrical-shaped body, said sliding collar being capable of moving between a first position and a second position relative to said cylindrical-shaped body;

wherein said sliding collar when in said first position collapses a portion of said first set of outwardly projecting cleaning wires and when in said second position collapses a portion of said second set of outwardly projecting cleaning wires.

3. A pipeline pig according to claim 2 wherein said sliding collar moves between said first and second position in response to a pipeline pressure.

4. A pipeline pig according to claim 3 further comprising said sliding collar including at least one radial disc.

5. A pipeline pig according to claim 2 wherein said sliding collar moves between said first and second position in response to a tether affixed to said sliding collar.

6. A pipeline pig according to claim 2 further comprising a plurality of guide rods for guiding said sliding collar between said first and second position, said plurality of guide rods being circumferentially disposed relative to said cylindrical-shaped body and located between said first and second ends of said cylindrical-shaped body.

7. A pipeline pig according to claim 2 further comprising means for stopping said sliding collar from moving beyond said first position and second position.

8. A pipeline pig according to claim 7 wherein said stopping means is a radial disc being located at each said first and second end of said cylindrical-shaped body.

9. A pipeline pig according to claim 2 further comprising said sliding collar having a neutral position between said first and second positions.

10. A pipeline pig according to claim 2 further comprising means for moving said sliding collar between said first and second positions.

* * * * *